US011364416B2

(12) United States Patent
Koskela

(10) Patent No.: US 11,364,416 B2
(45) Date of Patent: Jun. 21, 2022

(54) DEVICE AND METHOD FOR FOOT EXERCISE

(71) Applicant: VQ INNOVATION, Stockholm (SE)

(72) Inventor: Vesa Koskela, Stockholm (SE)

( * ) Notice: Subject to any disclaimer, the term of this patent is extended or adjusted under 35 U.S.C. 154(b) by 337 days.

(21) Appl. No.: 16/604,021

(22) PCT Filed: Apr. 4, 2018

(86) PCT No.: PCT/SE2018/050352
§ 371 (c)(1),
(2) Date: Oct. 9, 2019

(87) PCT Pub. No.: WO2018/190763
PCT Pub. Date: Oct. 18, 2018

(65) Prior Publication Data

US 2020/0155897 A1 May 21, 2020

(30) Foreign Application Priority Data

Apr. 10, 2017 (SE) ..... 1730103-7

(51) Int. Cl.
*A63B 23/10* (2006.01)
*A61H 1/02* (2006.01)
*A63B 23/08* (2006.01)

(52) U.S. Cl.
CPC ..... *A63B 23/10* (2013.01); *A61H 1/0266* (2013.01); *A63B 23/08* (2013.01);
(Continued)

(58) Field of Classification Search
CPC ..... A63B 23/10; A63B 23/08; A63B 21/0557; A63B 21/0442; A63B 23/03508;
(Continued)

(56) References Cited

U.S. PATENT DOCUMENTS 1,546,506 A * 7/1925 Naysmith ..... A61H 1/0266 606/237
5,087,036 A * 2/1992 Cooper ..... A63B 23/085 482/79

(Continued)

FOREIGN PATENT DOCUMENTS

DE 391628 C 3/1924
FR 2782648 A1 3/2000

(Continued)

OTHER PUBLICATIONS

Squeri, Michele; International Search Report received for International Patent Application No. PCT/SE2018/050352, dated Jun. 15, 2018, 5 pages.

(Continued)

*Primary Examiner* — Garrett K Atkinson

(57) ABSTRACT

There is provided a foot exercising device of exercising a foot using the device. The foot exercising device comprises a foot support and a tilting arrangement. A sensor means is arranged in the tilting arrangement and/or on the elevated footrest to measure the pressure applied to the calf and the pressure on the sole of a foot supported on the footrest respectively. A display means presents the measured pressure to an operator of the foot exercising device. There is also provided a method for controlling and/or monitoring an exercise of a foot using the foot exercising device.

20 Claims, 6 Drawing Sheets

(52) U.S. Cl.
CPC ..... *A61H 2201/1269* (2013.01); *A61H 2201/1676* (2013.01); *A61H 2201/5043* (2013.01); *A61H 2201/5061* (2013.01); *A61H 2201/5069* (2013.01); *A61H 2201/5071* (2013.01)

(58) Field of Classification Search
CPC ..... A63B 2023/006; A63B 21/4011; A63B 21/4015; A63B 2208/0252; A63B 21/00185; A63B 21/00181; A63B 22/20; A61H 1/0266; A61H 2201/1269; A61H 2201/1676; A61H 2201/5043; A61H 2201/5061; A61H 2201/5069; A61H 2201/5071; A61H 2201/5028; A61H 1/0237; A61H 1/0259; A61H 1/024; A61H 2201/0157; A61H 2201/0153; A61H 2203/0456; A61H 2203/045; A61H 2205/102; A61H 2201/1664; A61H 2205/106; A61H 2201/1671; A61H 2205/10; A61H 2201/1642; A61H 2201/1276; A61H 2201/1635
See application file for complete search history.

(56) References Cited

U.S. PATENT DOCUMENTS 5,582,567 A * 12/1996 Chang ..... A63B 22/16 482/132
5,645,516 A * 7/1997 Foster ..... A63B 21/0004 482/121
5,832,560 A * 11/1998 DePalma ..... A61F 13/041 16/30
6,244,992 B1 * 6/2001 James ..... A61H 1/0237 482/19
6,270,432 B1 * 8/2001 Matlock ..... A43B 3/0005 340/323 R
6,589,141 B1 * 7/2003 Flaggs ..... A63B 23/04 482/79
7,169,098 B1 * 1/2007 McGanty ..... A61H 1/0237 482/146
7,614,978 B2 * 11/2009 Piaget ..... A63B 21/0085 482/112
7,988,602 B1 * 8/2011 Janzen ..... A61H 1/0266 482/79
8,360,940 B2 * 1/2013 Kole ..... A63B 23/10 482/121
8,529,411 B2 * 9/2013 DiGiovanni ..... A63B 23/085 482/79
8,864,632 B2 * 10/2014 Johnson ..... A63B 22/20 482/79
9,114,278 B1 * 8/2015 Sigel ..... A63B 22/0605
9,364,382 B1 * 6/2016 Cooper ..... A61H 1/0266
9,415,260 B2 * 8/2016 Islas ..... A63B 21/4037
10,206,845 B1 * 2/2019 Barouche ..... A61H 1/0237
10,232,213 B1 * 3/2019 Smith, Jr. ..... A63B 23/1281
10,500,435 B2 * 12/2019 Balsells Mercade ..... A63B 22/0046
10,549,142 B1 * 2/2020 Ash ..... A63B 21/4034
10,926,124 B2 * 2/2021 Marti ..... A63B 21/00181
2004/0259704 A1 * 12/2004 Liang ..... A63B 22/16 482/146
2005/0014612 A1 * 1/2005 Sugiyama ..... A63B 21/00047 482/79
2007/0202996 A1 * 8/2007 Lu ..... A63B 22/0056 482/52
2008/0119765 A1 * 5/2008 Meckel ..... A61H 1/024 601/34
2009/0227386 A1 * 9/2009 Whitaker ..... A63B 69/3667 473/224
2010/0035734 A1 * 2/2010 DiGiovanni ..... A63B 23/085 482/79
2011/0124473 A1 * 5/2011 Kole ..... A63B 23/10 482/79
2013/0090216 A1 * 4/2013 Jackson ..... A63B 21/154 482/52
2014/0100086 A1 * 4/2014 Pagliaro ..... A61H 1/0266 482/91
2014/0215978 A1 * 8/2014 Phillips ..... A43C 17/02 54/83.1
2014/0274589 A1 * 9/2014 Harkins ..... A63B 21/00047 482/91
2015/0065273 A1 * 3/2015 Lake ..... A63B 69/0053 473/422
2015/0190668 A1 * 7/2015 Ferdinandsen, II . A63B 21/012 482/93
2015/0343261 A1 * 12/2015 Liptack ..... A63B 21/0004 482/80
2018/0214733 A1 * 8/2018 DeNunzio ..... A63B 21/4039
2018/0271735 A1 * 9/2018 Drucker ..... A63B 21/00047
2018/0290002 A1 * 10/2018 Colangelo ..... A63B 21/00043
2018/0318639 A1 * 11/2018 Kim ..... A63B 21/023
2020/0197743 A1 * 6/2020 Biele ..... A61H 1/0266
2020/0261758 A1 * 8/2020 Souffrain ..... A63B 21/4015

FOREIGN PATENT DOCUMENTS

WO 2008026981 A1 3/2008
WO 2016043973 A1 3/2016
WO 2016151527 A1 9/2016

OTHER PUBLICATIONS

Squeri, Michelei; Written Opinion for International Patent Application No. PCT/SE2018/050352, dated Jun. 15, 2018, 7 pages.
Kivikari, Jessica; Office Action received for Swedish Patent Application No. 1730103-7, dated Nov. 13, 2017, 8 pages.

* cited by examiner

DEVICE AND METHOD FOR FOOT EXERCISE

TECHNICAL FIELD

The present disclosure relates generally to an exercising device; and more specifically, to a device and a method of foot exercise. More specific the device and method concern controlling and/or monitoring of the foot exercise. The device and method according to the present invention can be used to advantage in both training and therapy.

BACKGROUND

A variety of foot deformities and symptoms (such as wrong positioning of bones, muscles and so forth) may exist in a foot of a person. Such foot deformities may be congenital or acquired, or both congenital and acquired. In an example, commonly known foot deformities include Achilles tendonitis, Flatfeet, Metatarsalgia, second metatarsal overload syndrome, Neuromas, Stiff big toe joint, Bunions, Limited big toe motion, Hammertoes, Heel pain, Posterior tibial tendon dysfunction (PTTD), Nerve compressions within the foot/ankle/neuropathy/neuroma,Anterior compartment syndrome, Patello-femoral pain syndrome, Plantar fasciitis, Tarsal tunnel syndrome, Hallux limitus, Hallux rigidus, Hallux valgus, and so forth. The deformities and the symptons above can be caused by weaknesses in the foot and in the calf muscle.

Presently, known techniques for treatment of the foot deformities include surgical procedures. The known surgical procedures include removal of abnormal bones, removal of bone enlargements, realignment of bones, realignment of cartilagenous surfaces of toe joints and so forth. However, the known surgical procedures give rise to long periods of recovery and a need for patients to wear a cast or surgical boot for weeks following the surgical procedures. Furthermore, the patients are often left with significant scars and poor cosmesis. Finally, the surgical procedures are costly, have a lengthy operating time, and require extensive pre/post-operative care from trained medical staff.

Alternatively, the treatment of the foot deformities may include physical medicine and rehabilitation treatments. Typically, such treatments include use of bunion pads, external splints, and use of exercising devices. However, the physical medicine and rehabilitation treatments are associated with various drawbacks. For example, known foot exercising devices may be designed specifically to target particular joints or muscles of the foot. Moreover, the foot exercising devices may be side specific, i.e. could be used either for a given left foot or for a given right foot.

Therefore, in light of aforementioned problems associated with known approaches for providing treatment for foot deformities, there exists a need to address, for example to overcome, the aforementioned drawbacks associated with the treatment of foot deformities. The problems mentioned above can be solved by a foot exercising device described in PCT/SE2016/050973.

Persons with the deformities and symptoms described above has been treated successfully in a foot exercising device described in PCT/SE2016/050973. However, it has been shown that there is a need to control and monitor the pressure applied to the calf and to the sole. The pressure could be too high, which may injure the patient. The pressure could also be too low, wherein the desired effect is not achieved.

SUMMARY

The present disclosure seeks to provide a foot exercising device to control and/or monitor an exercise of a foot. Moreover, the present disclosure also seeks to provide a method to control and/or monitor an exercise of a foot using the foot exercising device. The present disclosure seeks to provide an at least partial solution to the problems associated with the treatment of foot deformities.

In one aspect, an embodiment of the present disclosure provides a foot exercising device comprising:

- a foot support comprising
  - an elevated footrest to support a foot of a person thereon, wherein the elevated footrest forms a positive elevation between a heel and toes of the foot, wherein the positive elevation refers to positioning of the toes at a higher level with respect to the heel of the foot on the elevated footrest;
- a tilting arrangement, which is hingedly coupled to the footrest to exert pressure on a calf of the person, wherein the tilting arrangement is connected to a rod operable to move the tilting arrangement and exerting pressure on the calf for decreasing an angle between the calf and the foot of the person, characterized in

- a sensor means arranged in the tilting arrangement and/or on the elevated footrest to measure the pressure applied to the calf and the pressure on the sole of a foot supported on the footrest respectively; and
- a display means to display the measured pressure to an operator of the foot exercising device.

The present disclosure seeks to provide a foot exercising device, for example a non-invasive solution, for treatment of foot deformities and weaknesses. The foot exercising device is easy to operate and designed to target desired joints and/or muscles of the foot. This allows a user to perform effectively foot correction and strengthening exercises using the device of the present disclosure.

Optionally, a first sensor unit of the sensor means is arranged in the tilting arrangement.

Optionally, a second sensor unit of the sensor means includes at least one sensor arranged on the footrest to measure the pressure on the sole.

Optionally, the second sensor unit of the sensor means includes at least two sensors arranged on the footrest to measure the pressure distribution on the sole.

Optionally, an angle sensor is arranged to measure the dorsal flexion angle of the person using the foot excercising device.

Optionally, the angle sensor is arranged to measure the motion of the tilting arrangement to the footrest.

Optionally, an alert means is arranged at the foot exercising device to monitor the area where the heel of the person is supposed to be placed in order to alert when the heel lifts from the footrest during the treatment.

Optionally, the alert means is a switch arranged in the area where the heel of the person is supposed to be placed on the footrest, wherein the switch is connected to a lamp at the foot exercising device and wherein the lamp illuminates when the heel is lifted.

Optionally, the tilting arrangement comprising

- a pair of spaced apart fixed plates coupled to the elevated footrest;
- at least one movable plate hingedly coupled to the fixed plates;

a centre plate coupled with the at least one movable plate, the centre plate operable to receive a calf of the person, and a rod pivotally coupled to the centre plate, the rod operable to tilt the centre plate to exert pressure on at least the heel, the middle foot bones and the toes to perform foot correction exercises.

Optionally, a lift wedge is arranged on the elevated footrest and operable to receive the toes thereon to form a positive elevation between middle foot bones and the toes.

Optionally, the foot support of the foot exercising device further comprising a platform coupled to the elevated footrest for supporting the elevated footrest on a floor.

Optionally, the foot exercising device further comprises a detachable angled plate operable to be arranged between the lift wedge and the elevated footrest to form a positive elevation between a medial arch and a lateral arch of the foot of the person. More optionally, the angled plate forms the positive elevation in a range of 4 degrees to 25 degrees.

Optionally, the foot exercising device further comprising a see-saw plate, and a ridge member arranged on the elevated footrest, wherein the ridge member is coupled to a central portion of the see-saw plate to allow the see-saw plate to tilt about the ridge member to form the positive elevation between a medial arch and a lateral arch of the foot of the person.

Optionally, a see-saw plate sensor is arranged to measure the inclination of the see-saw plate.

Optionally, the lift wedge comprises at least one sloped surface.

Optionally, the tilting arrangement comprises a pair of spaced apart movable plates hingedly coupled to the fixed plates.

Optionally, the centre plate comprises a cushion to support the calf of the person.

Optionally the rod is tiltable sideways to optionally the left and to the right to enable the rod to pass the back of the person when tilting the centre plate.

In another aspect, an embodiment of the present disclosure provides a method for controlling and/or monitoring an exercise of a foot using the aforementioned device, the method comprising measuring the pressure on the calf of a person exercising in the exercising device; and/or measuring the pressure on the sole of the foot supported by the footrest;

storing of the measuring results in a storage medium; and presenting the measuring results to an operator on a display arranged at the foot exercising device.

Optionally, the method further comprises measuring the dorsal flexion angle of the person using the foot exercising device.

Optionally, the method further comprises alerting when the heel of the person lifts from the footrest.

Optionally, the method further comprises measuring inclination of the see-saw plate.

Additional aspects, advantages, features and objects of the present disclosure would be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those in the art will understand that the drawings are not to scale. Wherever possible, like elements have been indicated by identical numbers.

Embodiments of the present disclosure will now be described, by way of example only, with reference to the following diagrams wherein.

Figure 1:
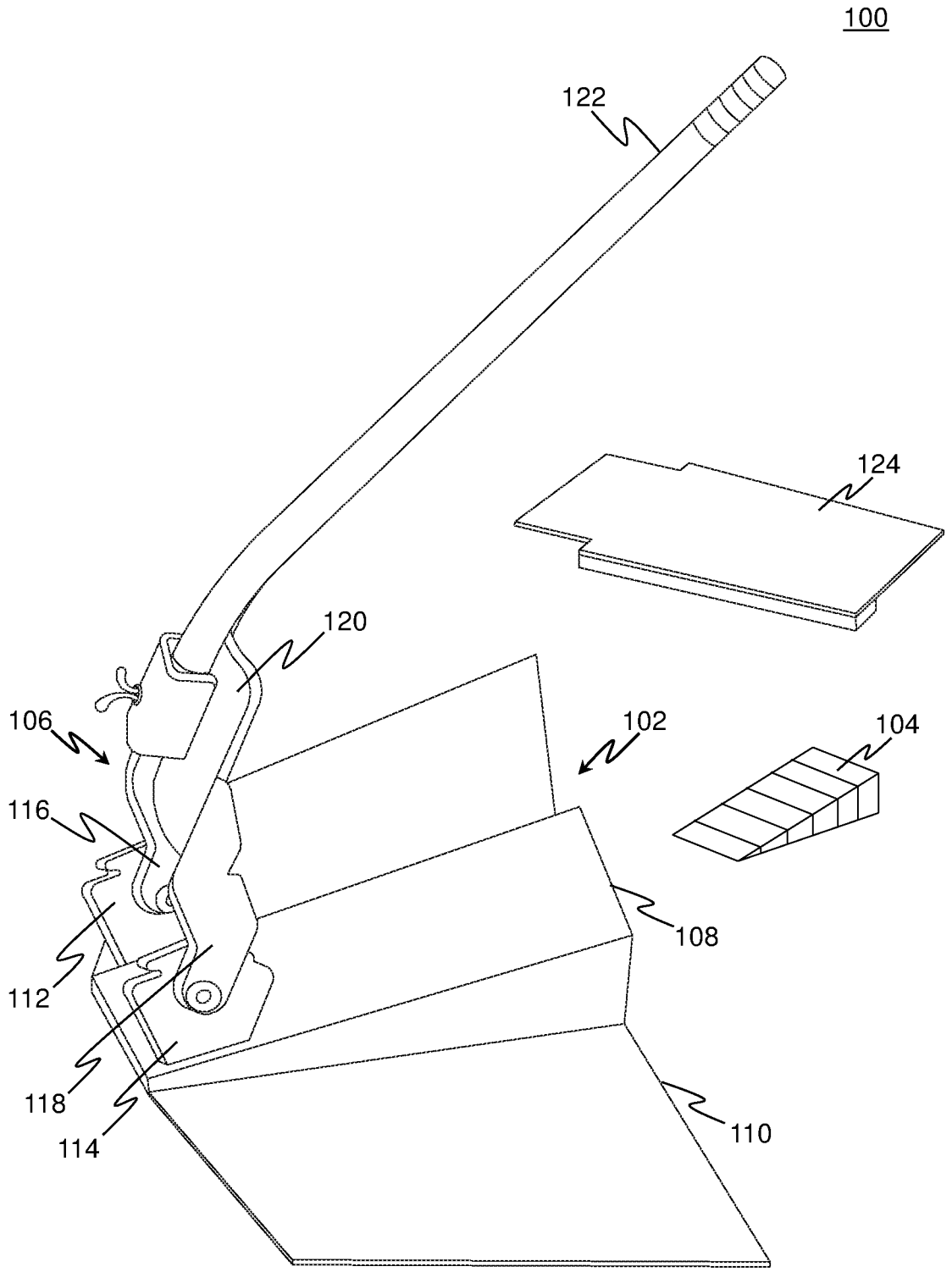
FIG. 1 is a perspective view of a foot exercising device described in PCT/SE2016/050973.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS

The following detailed description illustrates embodiments of the present disclosure and ways in which they can be implemented. Although some modes of carrying out the present disclosure have been disclosed, those skilled in the art would recognize that other embodiments for carrying out or practicing the present disclosure are also possible.

The foot exercising device described in PCT/SE2016/050973 comprises a foot support. The foot support comprises an elevated footrest to support a foot of a person thereon. In an embodiment, the foot support may further comprise a platform, for example an extended platform having an extensive floor-contact area, coupled to the elevated footrest for supporting the elevated footrest on a floor.

The elevated footrest forms a positive elevation between a heel and toes of the foot. In an embodiment, the elevated footrest may be a raised and inclined surface to support the foot of the person thereon. Specifically, the elevated foot rest may be a wedge-like structure that is operable to form the positive elevation between the heel and toes of the foot. More specifically, the positive elevation refers to positioning of the toes at a higher level with respect to the heel of the foot on the elevated footrest. It may be evident that dimensions, namely a physical size, of the elevated footrest are suitable to accommodate the foot of the person thereon. In an embodiment, the elevated footrest may be operable to decrease an angle between a leg and foot of the person.

Optionally, the foot support may further comprise the platform, namely the extended platform, coupled to the elevated footrest for supporting the elevated footrest on the floor. Specifically, the extended platform may have a flat, wing-like structure suitable to be placed on the floor. In an embodiment the extended platform may be operable to receive a non-exercising foot of the person thereon. In another embodiment, for a person with stiff legs, the extended platform may be vertically adjustable or may be raised by a separate block on the floor.

The foot exercising device further comprises a lift wedge to be arranged on the elevated footrest. The lift wedge is operable to receive the toes thereon to form a positive elevation between middle foot bones and the toes of the foot. In an embodiment, the lift wedge may be loosely placed and coupled to the detachable angled plate. Specifically, the lift wedge is slidably placed on the detachable angled plate operable to increase an angle between the toe and the elevated footrest.

In one embodiment, the at least one sloped surface of the lift wedge may be made of a soft material. Specifically, the soft material may provide support and/or cushioning to the foot of the person. In an example, the soft material to make the at least one sloped surface of the lift wedge may be fabricated from a flexible polymeric material (for example a polymeric foam or flexible silicone structure), an inflatable weight-bearing arrangement (such an air-pillow arrangement), an assembly of weight-bearing elements that are operable mutually to reconfigure their relative spatial positions for providing support (such as a "bean-bag" type support), a liquid-filled or gel-filled cavity having flexible walls, and so forth. Specifically, the at least one sloped surface of the lift wedge may be coated with cellular rubber (such as neoprene). In an embodiment, the lift wedge may be vertically adjustable. Specifically, the lift wedge may be adjusted vertically to form different positive elevations between middle foot bones and the toes of the foot, according to requirements of the person.

In an embodiment, the lift wedge may be rotatable in operation, and may be coupled to the elevated footrest in operation. Specifically, the lift wedge may be rotated in operation to change a position thereof on the elevated footrest. It may be evident that the rotation of the lift wedge allows treatment of both feet of the person. In an example, a person with foot deformities in both feet may rotate the lift wedge to perform foot correction exercises for each foot.

In an embodiment, the lift wedge comprises at least one sloped surface. The at least one sloped surface is operable to receive the toes of the foot thereon to form a positive elevation between middle foot bones and the toes of foot. Specifically, the positive elevation refers to positioning of the toes at a higher level with respect to the middle foot bone on the elevated foot rest, using the lift wedge.

In an example, the lift wedge has one sloped surface. The lift wedge may be placed under the foot and the toes in a specific manner so that the lift wedge provides a stretching effect to joints between the toes and the middle foot bones by forming the positive elevation thereon. Specifically, the lift wedge may be located between the distal interphalangeal joint of each toe, the proximal interphalangeal joint of each toe, the metatarsophalangeal joint and the metatarsal head of each toe of the foot of the person. The lift wedge placed in aforementioned position may exert pressure on the metatarsophalangeal joint and head forming the positive elevation and stretching of muscles connected thereto. In such example, the lift wedge may be aligned with a line through the third joint of the toes. A deviation of up to +/−20 degrees from said line through third joint of the toes is acceptable.

In another example, the lift wedge has two sloped surfaces. Specifically, the lift wedge with two sloped surfaces may be used to treat both, a left foot and a right foot of the person without turning the lift wedge. It may be evident that the lift wedge is operable to receive only one foot at a time.

In another example, the lift wedge is placed under at least one toe of the foot. The lift wedge may be operable to increase the angle between the at least one toe and the elevated footrest to maximum mobility of the at least one toe of the person. For example, the maximum mobility of the at least one toe may be up to 90 degrees.

Furthermore, the foot exercising device comprises a tilting arrangement comprising a pair of spaced apart fixed plates coupled to the elevated footrest, at least one movable plate hingedly coupled to the fixed plates, a centre plate coupled with the at least one movable plate and a rod pivotally coupled to the centre plate.

It may be evident that the pair of spaced apart fixed plates supports the at least one movable plate. Furthermore, the at least one movable plate supports the centre plate. In an embodiment, the tilting arrangement may comprise a pair of spaced apart movable plates hingedly coupled to the fixed plates.

The centre plate is operable to receive a calf of the person. In an embodiment, the centre plate may comprise a cushion to support the calf of the person.

Optionally the rod is tiltable sideways to optionally the left and to the right to enable the rod to pass the back of the person when tilting the centre plate.

The rod of the tilting arrangement is operable to tilt the centre plate to exert pressure on at least the heel, the middle foot bones and the toes to perform foot correction exercises. Specifically, the rod may be moved in a manner such that the angle between a leg (or calf) of the person supported by the centre plate, and the foot placed on the elevated footrest, is decreased.

In an embodiment, the foot exercising device may comprise a detachable angled plate operable to be arranged between the lift wedge and the elevated footrest to form a positive elevation between a medial arch and a lateral arch of the foot of the person. Specifically, the detachable angled plate has a wedge like structure of dimensions suitable to fully receive the foot of the person thereon. More specifically, the positive elevation refers to positioning of the medial arch at a higher position with respect to the lateral arch on the detachable angled plate. In an embodiment, the detachable angled plate may form the positive elevation in a range of 4 degrees to 25 degrees. In an example, the detachable angled plate may have triangular cross section.

In an embodiment, the detachable angled plate may be turnable. In an example, the detachable angled plate may be turned through an angle in a range of 140 to 240 degrees, for example substantially 180 degrees, to accommodate the foot of the person thereon. For example, the detachable angled plate may be a pronation plate or a supination plate.

In an embodiment, the detachable angled plate is placed under the foot in a manner such that the detachable angled plate may exert pressure on a lower leg, the heel, the middle foot bones of the foot and muscle groups connected thereto. Specifically, the pressure may be exerted by forming the positive elevation between a medial arch and a lateral arch of the foot of the person.

In an embodiment, the foot exercising device may comprise a see-saw plate and a ridge member arranged on the elevated footrest. The ridge member is coupled to a central portion of the see-saw plate allowing the see-saw plate to tilt about the ridge member to form the positive elevation between a medial arch and a lateral arch of the foot of the person. Specifically, the see-saw plate may be used to treat both, a left foot and a right foot of the person without turning the lift wedge. It may be evident that the see-saw plate is operable to receive only one foot at a time.

In operation, the foot exercising device of the present disclosure may be used for exercising the foot of the person. The foot of the person may be placed on the elevated footrest to form the positive elevation between the heel and the toes of the foot. Thereafter, the lift wedge may be arranged between the elevated footrest and the at least one toe of the foot for forming the positive elevation between the at least one middle foot bone and the corresponding toe of the foot. In an embodiment, the detachable angled plate may be arranged between the lift wedge and the elevated footrest to form the positive elevation between the medial arch and the lateral arch of the foot of the person. In another embodiment, the see-saw plate may be arranged between the lift wedge and the elevated footrest for forming the positive elevation between the medial arch and the lateral arch of the foot of the person. The calf of the person may be supported against the centre plate of the tilting mechanism, and the rod may be manoeuvred to exert pressure on at least the heel, the middle foot bones and the toes to perform foot correction and strengthening exercises. In an embodiment, exercising the foot further comprises releasing pressure from at least the heel, the middle foot bones and the toes of the foot by moving away the rod.

In an embodiment, the exertion and release of pressure on at least the heel, the middle foot bones and the toes of the foot by moving the rod may be performed alternately for pre-determined time periods. In an example, the pre-determined time period may be in a range of 1 to 3 minutes each, for example 2 minutes each, for exerting and releasing pressure.

In an embodiment, the foot of the person may be placed on the elevated footrest in a specific manner such that the positive elevation is formed between the heel and the toes. Such positioning of the heel may provide a stretching effect to the heel, the lower leg, the middle foot bones, and muscles related thereto. Moreover, arranging the lift wedge between the toes and the elevated foot rest may provide a stretching effect to the middle foot bones, the toes and muscles related thereto. In an embodiment, arranging the detachable angled plate between the lift wedge and the elevated footrest may provide a stretching effect to the medial arch, the lateral arch, the middle foot bones and muscles related thereto.

In an embodiment, pressure on at least the heel, the lower leg, the calf, the middle foot bones, the toes, the medial arch, the lateral arch and the muscles related thereto, may be exerted by manoeuvring the rod of the tilting arrangement. In an example, the manoeuvring the rod may lead to exerting pressure on the lower leg by decreasing the angle between the leg (or calf) and the foot.

In an embodiment, the rod may be manoeuvred by the person for exerting the pressure on the lower leg. In another embodiment, the rod may be manoeuvred by a medical staff for exerting the pressure on the lower leg. In still another embodiment the tilting arrangement may be manoeuvred by a power device, e.g. an electric motor, controlled by a computer program according to a preset treatment model.

In an embodiment, pressure on the lower leg may be exerted by moving a knee of the person in a specific manner so that the angle between the leg (or calf) and the foot of the persona may be decreased.

In an embodiment, the non-exercising foot of the person may be operable to release pressure exerted to at least the heel, the lower leg, the calf, the middle foot bones, the toes, the medial arch, the lateral arch and the muscles related thereto. Specifically, the non-exercising foot may be moved to a forward position (or bent) for releasing the pressure exerted on the lower leg.

PCT/SE2016/050973 presents also a method for exercising a foot using the device. The foot exercising device is easy to install in limited space and is easy to operate. Furthermore, the device and method of, namely method for, exercising the foot provides a non-invasive solution for treatment of foot deformities, thereby reducing high costs associated with surgery and the need for extensive pre/post-operative care. Moreover, the described device and method and system may be used to treat both left foot and right foot of the person in a safe manner to minimise risk of injury to the person. Additionally, the device and method are designed to target desired joints and/or muscles of the foot, which allows a user to efficiently perform foot correction exercises.

When stretching the calf muscles, there are often no effect even if a great force is applied when dorsalflexing in the ankle. The reason is that there is a stress applied to the arch during the stretch. The calf muscles react negatively on that and get tensed as a protection.

To get effect of the stretching you have to stabilize the lateral arch. It has to be protected from the natural stress impact when you attempt to bend to the maximum in the ankle.

This is done through stabilization of the lateral arch of the foot.

By placing a wedge, which lifts the lateral toes Metatarsal 4-5, there will be a tension in the plantar fascia and the structures attached between the toes and the heel bone (calcaneus). A tension of these structures get the bones/joints in the foot "linked" together to form a stable unit.

When stretching in this position there will be a stability in the foot that allow the calf and foot muscles to relax, wherein the muscles can relax during the exercise.

When dorsal flexing the foot, the peroneus longus tendon will, when passing over the cuboid in the peroneal groove, enhance the locking effect of the cuboid into its locking position.

In one aspect, an embodiment of the present invention comprising sensors to measure the pressure applied to the calf and/or the sole of a person using the foot exercising device.

In another aspect, an embodiment of the present disclosure provides a method to measure the pressure applied to the calf and/or the sole of a person using the foot exercising device.

It has been shown that the level of the exerted pressure and a time the pressure is exerted on the calf and the sole affect the result of the treatment and the possibility to remove the symptom or deformities in the foot of a person. Also the correlation between the pressure on the calf and the sole may be important to get a positive effect of the treatment. Therefore, storing of the pressure measurements from patients can be used to create different models of optimal pressure and optimal treatment periods. For example may the pressure be applied with pressure release in between the pressure intervals. It is obvious that exerting and releasing of pressure can be accomplished manually by an operator or automatically by a power device without diverting from the intention of the present invention. In an automatic mode for example, different treatment models can be stored in a computer. A treatment model program can be chosen according to a person's foot problem and started by the operator to control and monitor the treatment regarding treatment time and pressure levels by means of the power device.

DETAILED DESCRIPTION OF THE DRAWINGS

Referring to FIG. 1, there is shown an illustration of a perspective view of a foot exercising device 100, in accordance with an embodiment of device disclosed in PCT/SE2016/050973. The foot exercising device 100 comprises a foot support 102, a lift wedge 104, and a tilting arrangement 106. As shown, the foot support 102 comprises an elevated footrest 108 and a platform 110, for example implemented as an extended platform having an extensive floor-contact area for spreading weight on the floor-contact area when in operation. The elevated footrest 108 supports a foot of a person thereon, and the platform 110 is coupled to the elevated footrest 108 for supporting the elevated footrest 108 on a floor. The elevated footrest 108 is operable to form a positive elevation between a heel and toes of the foot. The lift wedge 104 to be arranged on the elevated footrest 108, is operable to receive the toes thereon to form a positive elevation between middle foot bones and the toes. As shown, the tilting arrangement 106 includes a pair of spaced apart fixed plates 112 and 114 coupled to the elevated footrest 108, a pair of spaced apart movable plates 116 and 118 hingedly coupled to the fixed plates 112 and 114, a centre plate 120 arranged between the pair of spaced apart movable plates 116 and 118, and a rod 122, pivotally coupled to the centre plate 120. The centre plate 120 is operable to receive a calf of the person. The rod 122 is operable to tilt the centre plate 120 to exert pressure on at least the heel, the middle foot bones and the toes to perform foot correction exercises. Optionally the rod is also tiltable sideways optionally to the left and to the right to enable the rod to pass the back of the person when tilting the centre plate. Optionally, the foot exercising device 100 may also comprise a detachable angled plate 124, as shown. The detachable angled plate 124 may be arranged between the lift wedge 104 and the elevated footrest 108 to form a positive elevation between a medial arch and a lateral arch of the foot of the person.

Figure 2:
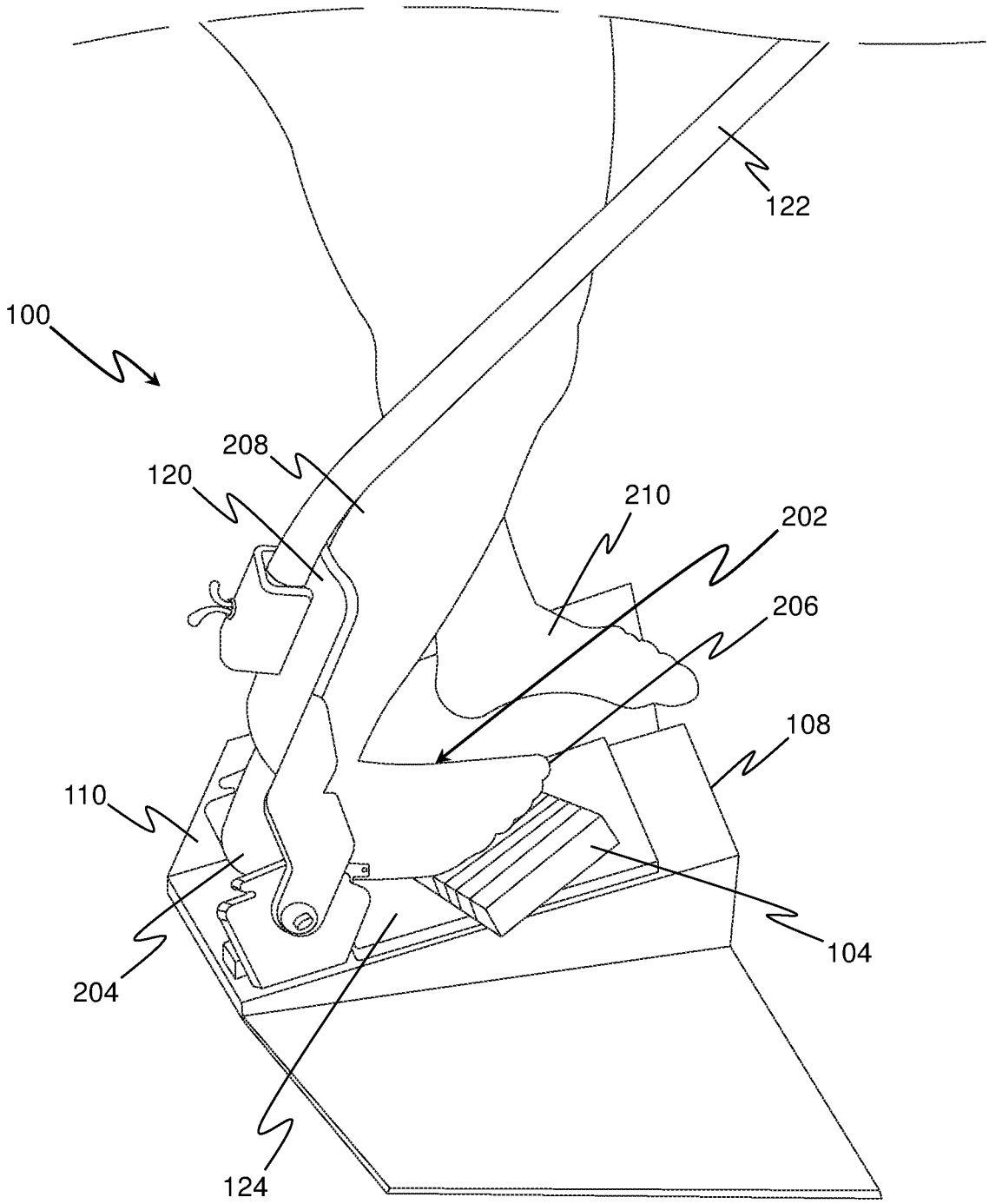
FIGS. 2 and 3 are perspective views of the foot exercising device of FIG. 1 in a used state.
Figure 3:
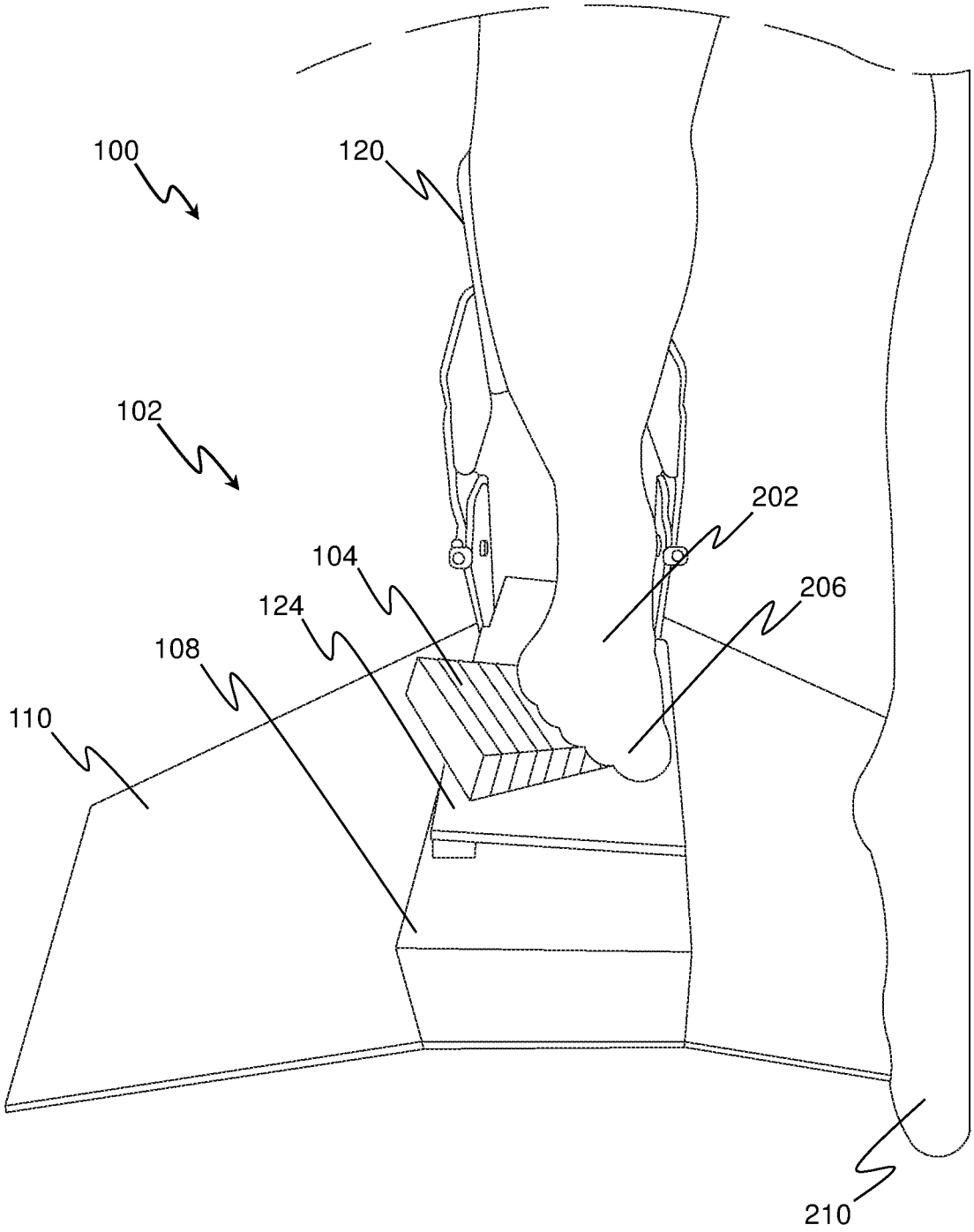

Referring to FIGS. 2 and 3, there are shown illustrations of perspective views of the foot exercising device 100 of FIG. 1 in a used state, in accordance with an embodiment of the present disclosure. Specifically, in the FIGS. 2 and 3, there are shown illustrations of side and front perspective views, respectively, of the foot exercising device 100 in the used state. As shown, a foot 202 of a person is supported on the elevated footrest 108 to form a positive elevation between a heel 204 and toes 206 of the foot 202. The lift wedge 104 (arranged on the elevated footrest 108) receives the toes 206 thereon to form a positive elevation between middle foot bones and the toes 206. Moreover, the detachable angled plate 124 is arranged between the lift wedge 104 and the elevated footrest 108 to form a positive elevation between a medial arch and a lateral arch of the foot 202 of the person. In an example, the detachable angled plate 124 forms the positive elevation in a range of 8 degrees to 25 degrees (4° to 25°). As shown, the centre plate 120 receives a calf 208 of the person. The rod 122 is operable to tilt the centre plate 120 to exert pressure on at least the heel 204, the middle foot bones, and the toes 206 to perform foot correction exercises. As shown, a non-exercising foot 210 of the person is received on the platform 110.

Figure 4:
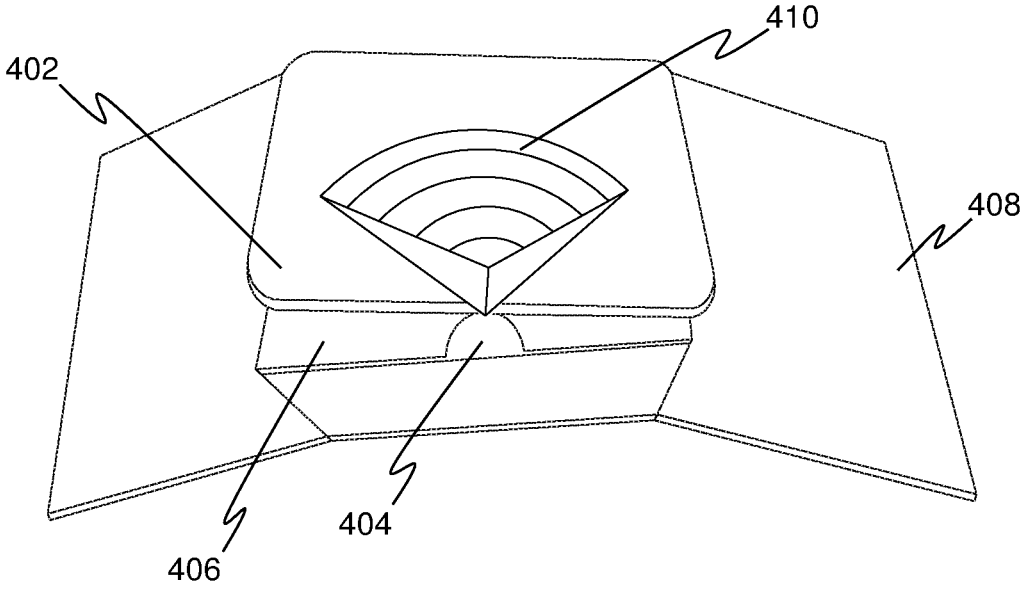
FIG. 4 is a perspective view of a foot exercising device, in accordance with another embodiment of the foot exercising device described in PCT/SE2016/050973.

Referring to FIG. 4, there are shown illustrations of a perspective view of a foot exercising device 4, in accordance with another embodiment of the present disclosure. The foot exercising device is structurally and functionally similar to the foot exercising device 100, explained in conjunction with FIGS. 1 to 3. However, as shown, the foot exercising device includes a see-saw plate 402 and a ridge member 404. The ridge member 404 is arranged on an elevated footrest 406. Furthermore, the ridge member 404 is coupled to a central portion of the see-saw plate 402 to allow the see-saw plate 402 to tilt about the ridge member 404 to form the positive elevation between a medial arch and a lateral arch of a foot of the person. A platform 408, for example an extended platform having an extensive floor-contact area, is coupled to the elevated footrest 406. As shown, a lift wedge 410 comprising two sloped surfaces is arranged on top of the see-saw plate 402. The lift wedge 410 is operable to receive toes of the foot thereon to form a positive elevation between middle foot bones and the toes. It may be evident that the foot exercising device may also include a tilting arrangement (not shown).

The inclination of the see-saw plate is infinitely variable or variable in a number of positions. In one embodiment of the present disclosure a not shown sensor is arranged to measure the inclination of the see-saw plate.

Figure 5:
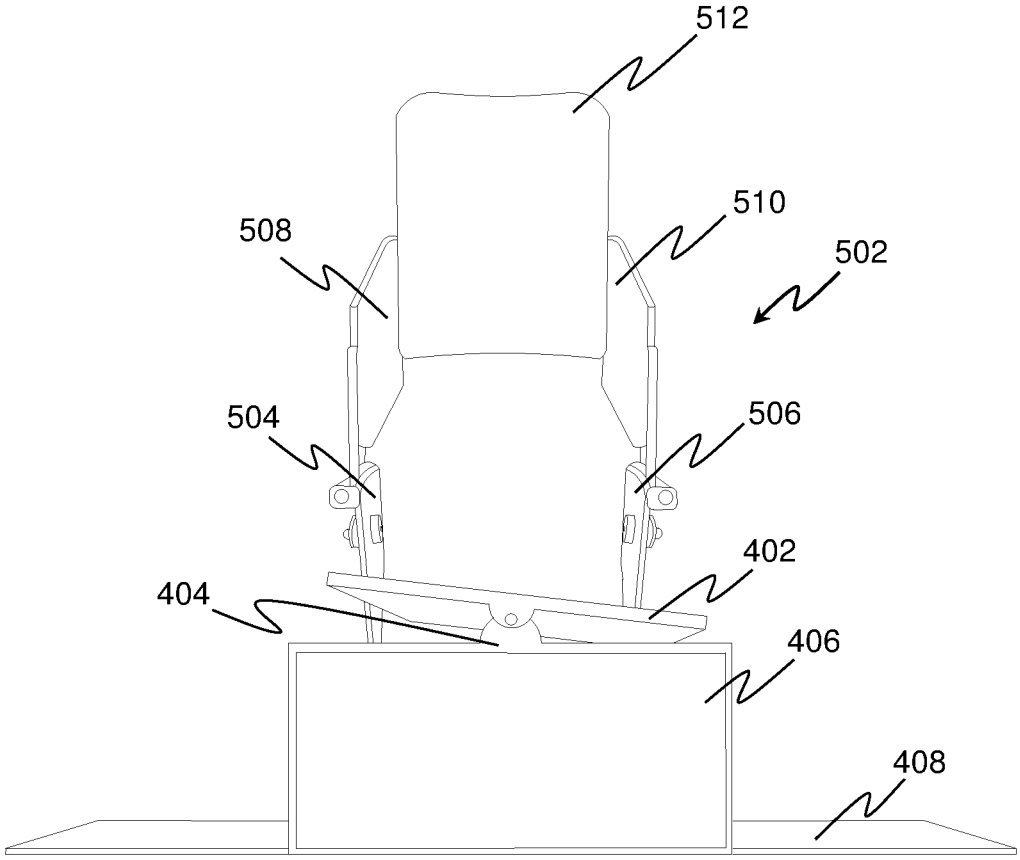
FIG. 5 is a front view of the foot exercising device of FIG. 4.

Referring to FIG. 5, there is shown an illustration of a front view of the foot exercising device of FIG. 4, in accordance with an embodiment of the present disclosure. As shown, the ridge member 404 is arranged on the elevated footrest 406. The ridge member 404 is coupled to a central portion of the see-saw plate 402 to allow the see-saw plate 402 to tilt about the ridge member 404. A lift wedge (not shown) may be arranged on top of the see-saw plate 402. The foot exercising device also includes a tilting arrangement 502 including a pair of spaced apart fixed plates 504 and 506 coupled to the elevated footrest 406, a pair of spaced apart movable plates 508 and 510 hingedly coupled to the fixed plates 504 and 506, a centre plate 512 arranged between the pair of spaced apart movable plates 508 and 510, and a rod (not shown), pivotally coupled to the centre plate 512.

Figure 6:
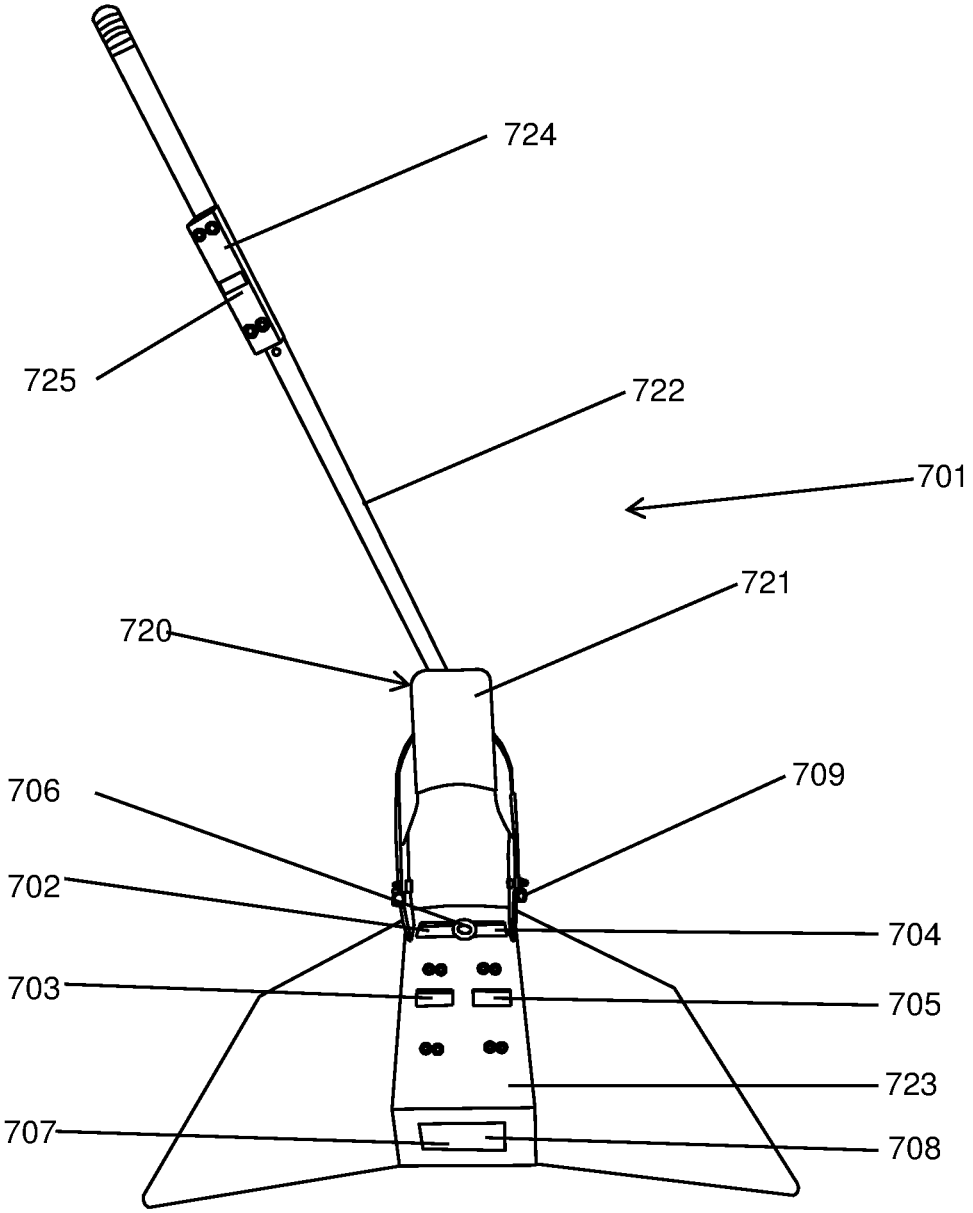
FIG. 6 is a front view of a foot exercising device in accordance with one embodiment of the present invention.

Referring to FIG. 6, there is shown a foot exercising device 701 provided with a number of sensors according to the present invention. A pressure sensor 725 is arranged on a tilt rod 722. The rod is divided into two parts, wherein a lower part is connected to a central plate 720 operable to receive a calf of the person and an upper part, which is operable to exert a pressure on the calf. The upper and lower parts are connected by means of a bracket 724 and the pressure sensor is mounted in the bracket to sense the bending force exerted when the upper part is pushed forwards to apply a pressure on the calf. Alternatively the pressure sensor is arranged on central plate 720 behind a cushion 721. This sensor measures the pressure applied on the calf by means of the tilt rod 722. Footrest sensors 702-705 are placed in a respective recess in an upper plate of the footrest 723. The recesses are distributed on the upper plate, whereby the sensors 702-705 can measure a pressure distribution on the sole. A dorsal flexion angle sensor 709 is arranged in a hinge rod connecting the tilting arrangement and the fixed footrest. An alert switch 706 is arranged on the footrest upper plate in an area where the heel of a person is supposed to be placed. When the heel is lifted from the footrest an alert, e.g. a lamp, will be activated. Alternatively the alert may be effected by means of a webcam or a light beam-sensor combination. Displays 707 and 708 are arranged on the front plate of the footrest 723 to present the measurements from the sensors.

Figure 7:
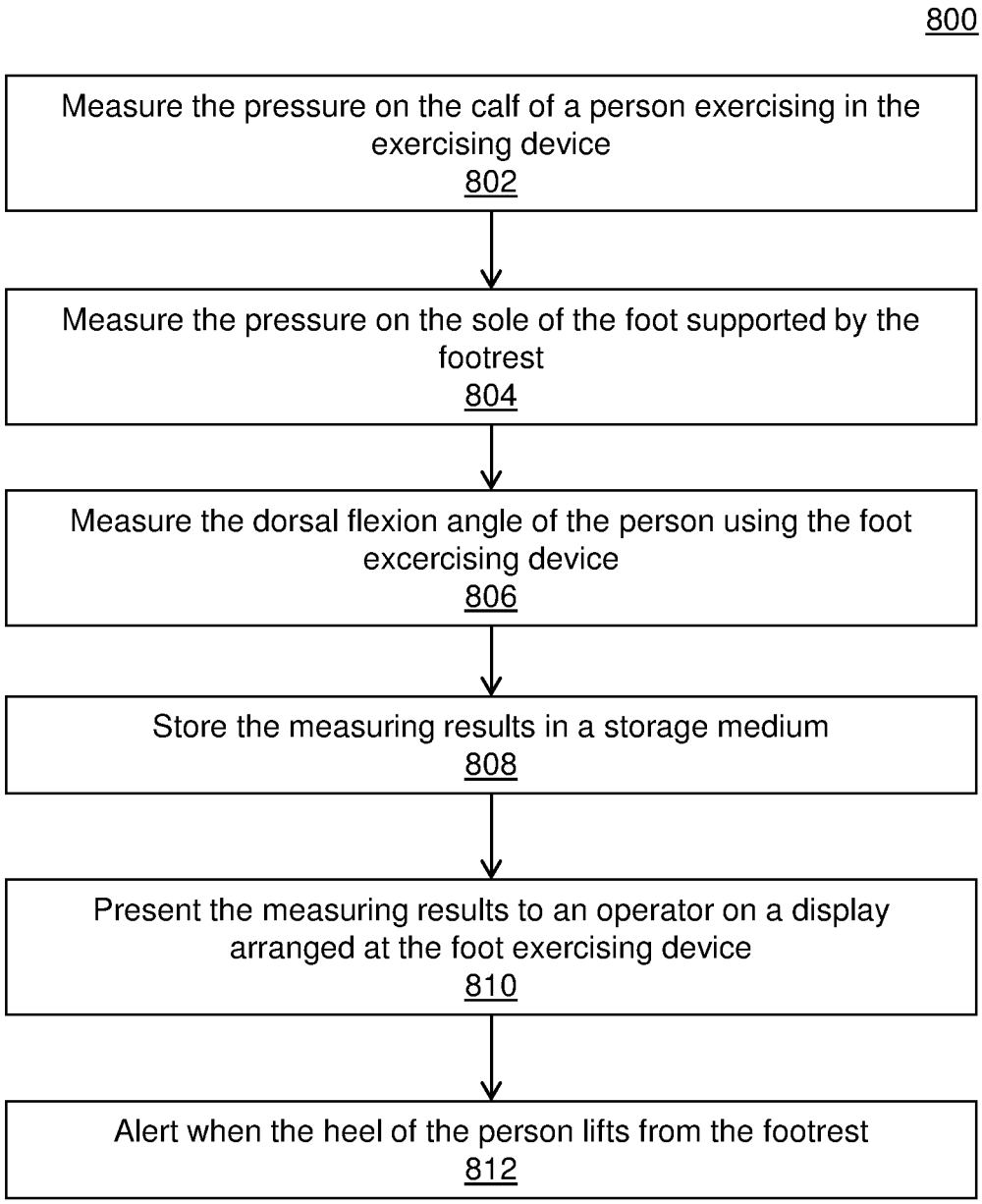
FIG. 7 illustrates steps of a method for exercising a foot using the foot exercising device, in accordance with one embodiment of the present invention.

Referring to FIG. 7, illustrated are steps of a method 800 to control and monitor the exercising a foot using the foot exercising device (such as the foot exercising devices 100, 400 and 701 of FIGS. 1 to 6), in accordance with an embodiment of the present disclosure. At step 802, the pressure on the calf of a person exercising in the exercising device is measured. At step 804, the pressure on the sole of the foot supported by the footrest is measured. At step 806, the dorsal flexion angle of the person using the foot exercising device is measured. At step 808, the measuring results is stored in a storage medium. At step 810, the measuring results is presented to an operator on a display arranged at the foot exercising device. At step 812, an alert is activated when the heel of the person lifts from the footrest.

The steps 802 to 812 are only illustrative and other alternatives can also be provided where one or more steps are added, one or more steps are removed, or one or more steps are provided in a different sequence without departing from the scope of the claims herein. For example, the method 800 may comprise releasing pressure from at least the heel, the middle foot bones and the toes of the foot by moving away the rod.

According to the described method a person to exercise or to be treated could be in a sitting or in a standing position, wherein the exercise or the treatment of the foot can be performed with the knee in a bent and in an extended position.

When the person is in a sitting position with the knee bent the pressure on the sole of the foot are resisted by a counter hold above the knee. In a sitting position with the knees extended the pressure on the sole of the foot is resisted by the lower back and the pelvis.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

The invention claimed is:

1. Foot exercising device comprising:

a foot support including:

an elevated footrest configured to support a foot of a person thereon, wherein the elevated footrest forms a positive elevation between a heel and toes of the foot, wherein the positive elevation refers to positioning of the toes at a higher level with respect to the heel of the foot on the elevated footrest;

a tilting arrangement, which is hingedly coupled to the footrest to exert pressure on a calf of the person, wherein the tilting arrangement includes:

a pair of spaced apart, fixed plates coupled to the elevated footrest;

at least one movable plate hingedly coupled to the fixed plates;

a center plate coupled with the at least one movable plate, the center plate operable to receive a calf of the person, and a rod pivotally coupled to the center plate and operable to tilt the center plate to exert pressure on at least the heel, middle bones of the foot and the toes to perform foot correction exercises;

a sensor means arranged in the tilting arrangement and on the elevated footrest to measure the pressure applied to the calf and the pressure on the sole of a foot supported on the footrest respectively;

a display means to display each measured pressure to an operator of the foot exercising device; and an alert means arranged to alert when a heel of a user lifts from the footrest during treatment.

2. The foot exercising device according to claim 1, wherein a sensor unit of the sensor means is arranged in the tilting arrangement.

3. The foot exercising device according to claim 1, wherein a sensor unit of the sensor means includes at least one sensor arranged on the footrest to measure the pressure on the sole.

4. The foot exercising device according to claim 3, wherein the sensor unit of the sensor means includes at least two sensors arranged on the footrest to measure pressure distribution on the sole.

5. The foot exercising device according to claim 1, further comprising an angle sensor arranged to measure the dorsal flexion angle of the person using the foot exercising device.

6. The foot exercising device according to claim 5, wherein the angle sensor is arranged to measure the motion of the tilting arrangement to the footrest.

7. The foot exercising device according to claim 1, wherein the alert means further comprises a switch arranged on the footrest and coupled with a lamp configured to illuminate when the heel is lifted.

8. The foot exercising device according to claim 1, further comprising a lift wedge arranged on the elevated footrest and operable to receive the toes thereon to form a positive elevation between the middle foot bones and the toes.

9. The foot exercising device according to claim 8, further comprising a detachable angled plate configured for placement between the lift wedge and the elevated footrest to form a positive elevation between a medial arch and a lateral arch of the foot of the person.

10. The foot exercising device according to claim 9, wherein the detachable angled plate forms the positive elevation in a range of about 4 degrees to about 25 degrees.

11. The foot exercising device according to claim 8, wherein the lift wedge comprises at least one sloped surface.

12. The foot exercising device according to claim 1, wherein the foot support further comprises a platform coupled to the elevated footrest for supporting the elevated footrest on a support surface.

13. The foot exercising device according to claim 1, further comprising, a see-saw plate, and a ridge member arranged on the elevated footrest at a central portion of the see-saw plate to allow the see-saw plate to tilt about the ridge member to form the positive elevation between a medial arch and a lateral arch of the foot of the person.

14. The foot exercising device according to claim 13, further comprising a see-saw plate sensor arranged to measure the inclination of the see-saw plate.

15. The foot exercising device according to claim 1, wherein the tilting arrangement comprises a pair of spaced apart, movable plates hingedly coupled to the fixed plates.

16. The foot exercising device according to claim 1, wherein the center plate comprises a cushion configured to support the calf of the person.

17. The foot exercising device according to claim 1, wherein the rod is configured for selective sideways tilting left or right to enable the rod to pass the back of the person when tilting the center plate.

18. A method of controlling and/or monitoring exercise of a foot, comprising:

providing the foot exercising device of claim 1;

measuring pressure on a calf of a person exercising in the foot exercising device and measuring pressure on a sole of a foot supported by the footrest of the foot exercising device;

storing each measured pressure in a storage medium;

presenting each measured pressure to a display operatively coupled with the foot exercising device; and providing an alert when a heel of the person is lifted from the footrest.

19. The method according to claim 18, further comprising measuring an angle of dorsal flexion of the person.

20. The method according to claim 18, further comprising measuring inclination of a see-saw plate of the foot exercising device.

* * * * *